United States Patent [19]

Finn

[11] 4,156,447

[45] May 29, 1979

[54] BILLFOLD FILE

[76] Inventor: Donald J. Finn, Apartment 713 - Sea Ranch Club, 5100 N. Ocean Blvd., Fort Lauderdale, Fla. 33308

[21] Appl. No.: 945,885

[22] Filed: Sep. 26, 1978

Related U.S. Application Data

[63] Continuation of Ser. No. 795,647, May 10, 1977, abandoned.

[51] Int. Cl.[2] ..... A45C 1/06

[52] U.S. Cl. ..... 150/38

[58] Field of Search ..... 150/38, 39, 30

[56] References Cited

U.S. PATENT DOCUMENTS

| | | | |
|---|---|---|---|
| 1,749,020 | 3/1930 | Curry | 150/38 |
| 2,871,901 | 2/1959 | Nash | 150/39 |

*Primary Examiner*—Donald F. Norton

*Attorney, Agent, or Firm*—Hiram A. Sturges

[57] ABSTRACT

A billfold file for receiving currency bills having panels of flexible material attached together at portions of the panels which are substantially spaced toward one end of the panels from a center thereof, the panels each being free of any connection to any other panel at the oppsite end-half of said panel assembly from the attaching means and also free of any connection at the center of the panel assembly for ease of folding.

8 Claims, 3 Drawing Figures

BILLFOLD FILE

This application is a continuation of application Ser. No. 795,647 filed May 10, 1977 now abandoned.

BACKGROUND OF THE INVENTION

The concept of this invention was made a long time after earlier billfold concepts of my own. The earlier concepts solved the problem of a billfold bill file sutiable for double fold billfolds. The solution had been to secure the panels of the file together at the center of the lower side thereof by heat bonding or else by securing the panels together by means of the edge stitching of a billfold by having the edge stitching go through a downwardly extending boss protruding from the underside of each of the panels, the boss being disposed at the center between the ends of the billfold. This solved the problem in double fold billfolds of making it possible to fold the billfold at a time when the file was full of bills and at a time, therefore, when the radius of bending at each of the two of the two-fold bill file would be great. The problem caused by the bending of a file at a time when it is full of bills is that there is much required movement of each outer one of the panels at the bend and all along each outer panel as compared with the inner-most panel which bends the least because its radius of bending is the least.

This gradually increased the amount of required movement as one progressively considers each panel disposed outwardly from the inner-most panel of a group of bent panels is the most serious problem indeed. The problem is particularly acute because the panels must then twist and wrinkle and make the billfold buckle because the panels need to move and yet they are secured together.

I had considered the use of a file as described with the panels secured together at the center of their underside for use in a single fold billfold as well as a double fold billfold. I was troubled, however, with the fact that there is much wrinkling because the securing in that case is, therefore, at the bend in the billfold if that same structure is used in a single fold billfold which, therefore, folds at the center between its ends.

I had conceived of expensive solutions to the problem of a file of this general type for a single fold billfold and had long been involved in that creative work when it finally occurred to me that the solution for a single fold billfold is to place the position of securing the panels together substantially spaced to one side of the center between the ends of the panels where the attachment would not be in the bend area. I tried this and discovered that is worked. It worked with the multiple panel unit loosely disposed in a single fold billfold. It also worked, as I discovered, with the panel unit stitched into a single fold billfold by providing a boss protruding from all or one of the panels and extending out toward the edge of the billfold so as to be stitched into the billfold where the usual stitching goes for securing the forward and rearward walls of the billfold together, provided, however, that the stitching in the bosses was substantially spaced from the center between the right and left ends of the panels so as to dispose it outwardly beyond the portions of the panels which would be disposed between bent portions of the forward and rearward walls of the billfold at times when the billfold is in a folded condition. This has seemed to make the ideal solution for a single fold billfold currency bill file.

SUMMARY OF THE INVENTION

The major object of this invention is to provide a billfold file for receiving currency bills and particularly adapted for use in a billfold of the single fold type and having panels of flexible material between which bills can be stored, the panels being secured together at portions of the said panels which are substantially spaced toward one end of said panels from a center thereof so as to dispose said panel securing portions outside of that portion of the billfold file which would be opposite those parts of a billfold file which would be opposite those parts of a billfold which would be bent when the file is in a billfold and the billfold is in a folded condition, the means for attaching the panels together being either in addition to or a part of another means for securing a billfold to the file, which latter can be stitching extending through forward and rearward walls of the billfold and also through one or more of said panels, said stitching extending through a tab protruding from at least one of said panels, the remaining parts of said panels being free of connection to each other and to said billfold.

DESCRIPTION OF THE PREFERRED EMBODIMENT

The billfold bill file of this invention is generally indicated at 10 in FIG. 1 and comprises a panel assembly, generally indicated at 20, which latter comprises a plurality of panels 30 each of which are disposed in parallelism and each of which are made from flat stock of sheet material, the material being a thin thermoplastic material later described.

Figure 1:
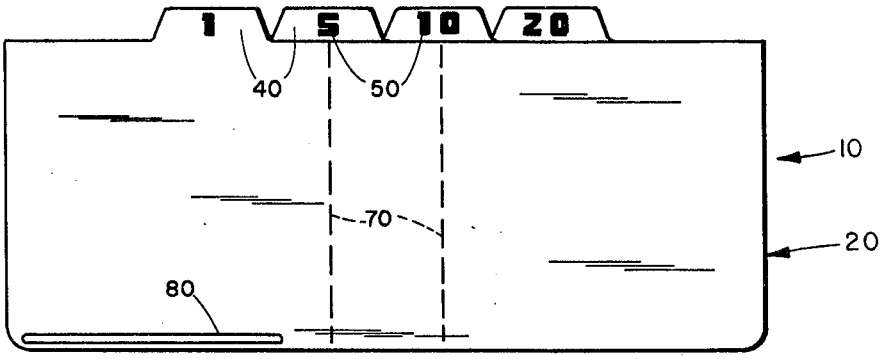
FIG. 1 is a side elevation of a panel assembly which can be called a billfold bill file, dotted lines thereon indicating the outer edges of a central portion of the bill file which would be disposed opposite bent portions of a one fold billfold if the panel assembly of FIG. 1 were in such a billfold.
Figure 2:
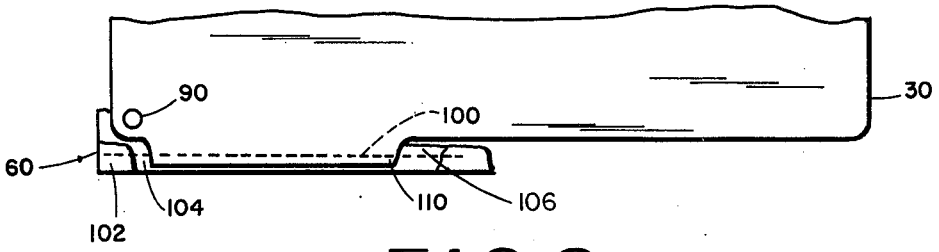
FIG. 2 is a side elevation of a billfold with the billfold bill file panel assembly of this invention secured thereto by stitching, only some portions of a lower left corner of the billfold being shown, the remainder of the billfold and the upper part of the panel assembly bein broken away for convenience of illustration.
Figure 3:
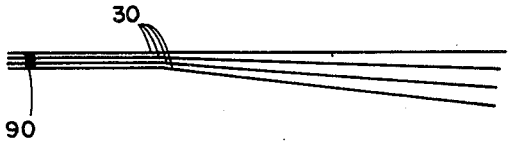
FIG. 3 is a top plan view of the left hand half of the panel assembly of FIG. 2, shown for the purpose of indicating how the panels can be secured together such as by a spot of heat bonding to hold the panels together preparatory to their being stitched into a billfold. Those parts of the panels shown on the right in FIG. 3 are purposely spaced apart to indicate that the panels are free to be spaced apart toward the right from parts of the panels which are secured together or to a billfold.

The panels 30 are of generally oblong rectangular shape, whereby they are elongated from left to right as seen when they are disposed in an open billfold position such as in FIGS. 1 and 2.

At the tops of the panels 30 each panel has an upwardly protruding tab for receiving thereon indicia 50, each of which designates by number a different billfold currency denomination.

The tabs 40 and 50 are staggered, as seen in side elevation, and are received within a billfold, although only a part of a billfold is shown and is indicated at 60 in FIG. 2 with only the lower left hand portion of the billfold being shown.

In FIG. 1 two vertical dotted lines are shown at 70 and these indicate the left and right boundaries of an area of the panel assembly 20 which would be disposed between the bent portions of a one-fold billfold when the latter is in folded conditon with a substantial number of currency bills disposed between the panels 30.

It is necessary that an attachment means such as a heat bonding of the panels 30 together and, therefore, called an attachment heat bonding line 80 of FIG. 1 be no closer to the center between the ends of the panels 30 than the closest of lines 70 in order that the panels bend properly without wrinkling when full of bills. It is furthermore preferred that the closest part of the attachment heat bonding 80 be disposed a substantial distance from the closest of the lines 70.

In the modification of FIG. 2 an attachment means or a holder spot attachment heat bonding is shown at 90 and it is of a small size but suitable for holding the panels in desired alignment while they are being assembled into a billfold by an attachment means or billfold securing means such as stitching 100 which is the usual stitching that goes around the outer edge of a billfold. In the modification of FIG. 2 the stitching 100 extends through the forward and rearward walls 102 and 104 of the billfold and also extends through a downwardly extending boss portion 110 of each of the panels 30, which latter extends downwardly on a certain side, specifically the left end of the bottom side of the panel assembly 30, as shown in FIG. 2, although it is to be understood that any securing means of panels together or panels to billfold that may be described herein can be disposed on the right hand side of center instead of the left hand side equally effectively.

The exact position of the holder spot attachment 90 is not critical as long as it is out of the area that would be occupied by currency bills. For example, it can be in the area occupied by the stitching 100, and, in fact, the holder spot could be stitching itself instead of heat bonding. Likewise, the heat bonding line 80 could also be for bonding the panel assembly to a billfold if the billfold were made of thermoplastic material, rather than leather.

It is important that, although the panels of the panel assembly are secured together at one end, they must not be secured together at both ends. Likewise, even though they can be secured to the billfold at one end, they must not be secured together or to the billfold at an opposite end in such a case. This is because if the panels are bound at both ends they will wrinkle when bills are in them and folding is involved.

The material of the panels is preferably a thin thermoplastic material. Some thermoplastic materials can be heat bonded and others cannot. Vinyl materials can be heat bonded. Polypropylene is useful when stitching is used to hold the panels together and to the billfold.

Ten mil virgin vinyl is suitable panel material and seven mil rigid vinyl will work or even six mil rigid vinyl will work and it is to be understood that the term "rigid vinyl" describes a flexible panel capable of bending with the billfold with ease. Six or seven mill polypropylene is very effective as a panel material.

The areas between the panels 30 are open when the panels are unfolded and are of generally oblong-rectangular shape as can be visualized in FIG. 1 and are of a length greater by more than double the height thereof for receiving currency bills.

I claim:

1. A billfold and billfold file assembly comprising a billfold file having a panel assembly for receiving currency bills, said panel assembly being for carrying inside a billfold for quick and easy and accurate storage and removal of bills, said panel assembly comprising: a plurality of vertical panels of flexible material, said panels being disposed in substantial parallelism, each two adjacent ones of said panels having a vertical bill receiving area therebetween, said bill receiving areas each being open at the upper edges of said panels, a billfold said billfold having a vertical cavity therein opening upwardly, said panel assembly being disposed in said cavity, said billfold having forward and rearward vertical walls which are disposed in lapping relationship with respect to each other and having billfold bottom and end edges, said billfold and billfold file assembly having attaching means, said attaching means securing said walls of said billfold together at said bottom and end edges thereof, said attaching means securing said panels together into said panel assembly, said attaching means securing said panel assembly to said billfold at a place spaced toward one end of said billfold a substantial distance from the center thereof so as not to be in an area where said billfold would be bent if said billfold were folded at the center between its ends while containing currency bills, said attaching means securing said panels to said billfold at only one side of said area of billfold, the upper half of said panel assembly being free of said attaching means so bills can more freely be inserted downwardly into said bill-receiving area, each of said panels being provided with an index tab extending upwardly therefrom, indicia means of each of said tabs.

2. The billfold bill file of claim 1 in which said billfold securing means is stitching.

3. The billfold file of claim 1 in which said panels are each formed of polypropylene.

4. The billfold file of claim 1 having said panels each formed of polypropylene of approximately a thickness of 6 ½ mils so as to provide an adequate stiffness for said tabs.

5. The billfold file of claim 1 having at least one of the panels of said panel assembly having an outwardly extending boss protruding from a lower half portion thereof, said boss of said one panel being disposed between said forward and rearward walls of said billfold, said billfold securing means securing said boss to at least one of said walls of said billfold.

6. The billfold file of claim 5 in which said billfold securing means is stitching which extends from said forward wall of said billfold through said boss and through the rearward walls of said billfold.

7. The billfold file of claim 6 having each of said panels having a boss disposed alongside said first mentioned boss and in which said stitching extends through each of said bosses.

8. The billfold file of claim 5 having said means for attaching said panels together comprising heat bonding and in which said panels are specifically formed of a thermoplastic material.

* * * * *